US008721325B2

(12) United States Patent
Geiger et al.

(10) Patent No.: US 8,721,325 B2
(45) Date of Patent: May 13, 2014

(54) METHOD FOR STARTING A COMBUSTION DEVICE UNDER UNKNOWN BASIC CONDITIONS

(75) Inventors: Ulrich Geiger, Bogen (DE); Martin Geiger, Bogen (DE); Rudolph Tungl, Ergolding (DE)

(73) Assignee: ebm-papst Landshut GmbH, Landshut (DE)

( * ) Notice: Subject to any disclaimer, the term of this patent is extended or adjusted under 35 U.S.C. 154(b) by 1215 days.

(21) Appl. No.: 12/224,021

(22) PCT Filed: Feb. 7, 2007

(86) PCT No.: PCT/EP2007/001050

§ 371 (c)(1),
(2), (4) Date: Aug. 13, 2008

(87) PCT Pub. No.: WO2007/093312

PCT Pub. Date: Aug. 23, 2007

(65) Prior Publication Data

US 2009/0148798 A1 Jun. 11, 2009

(30) Foreign Application Priority Data

Feb. 14, 2006 (DE) ..... 10 2006 006 964

(51) Int. Cl.

| | |
|---|---|
| ***F23N 5/20*** | (2006.01) |
| ***F23N 1/02*** | (2006.01) |
| ***A01G 13/06*** | (2006.01) |
| ***F23N 5/00*** | (2006.01) |
| ***F24H 9/20*** | (2006.01) |

(52) U.S. Cl.
USPC ..... 431/6; 431/12; 431/18; 431/76; 236/11

(58) Field of Classification Search
USPC ..... 431/6, 12, 18, 176; 236/11
See application file for complete search history.

(56) References Cited

U.S. PATENT DOCUMENTS 5,984,664 A * 11/1999 Sutton ..... 431/76

FOREIGN PATENT DOCUMENTS

| | | | |
|---|---|---|---|
| DE | 102 00 128 | A1 | 7/2003 |
| DE | 20 2004 017851 | U1 | 7/2005 |
| EP | 1 207 340 | A2 | 5/2002 |
| EP | 1 522 790 | A | 4/2005 |
| GB | 2 270 748 | A | 3/1994 |

* cited by examiner

*Primary Examiner* — Kenneth B Rinehart
*Assistant Examiner* — William Corboy
(74) *Attorney, Agent, or Firm* — Harness, Dickey & Pierce, P.L.C.

(57) ABSTRACT

A method for starting a combustion device, in particular after a first ignition failure, in particular for starting a gas burner under unknown basic conditions, wherein a characteristic diagram of a start air ratio depending on the burner temperature known from empirical analysis is stored for the combustion device in a memory, wherein a calibration of the starting process is performed, wherein the ratio of opening of the gas valve (w) to air volume $m_L$ necessary for ignition is iteratively determined by variation of the gas and/or air volume; and in case of ignition, the combustion device is started and the applicable air ratio $(\lambda)_{IGNITION}$ is stored.

14 Claims, 3 Drawing Sheets

METHOD FOR STARTING A COMBUSTION DEVICE UNDER UNKNOWN BASIC CONDITIONS

CROSS-REFERENCE TO RELATED APPLICATIONS

Figure 1:
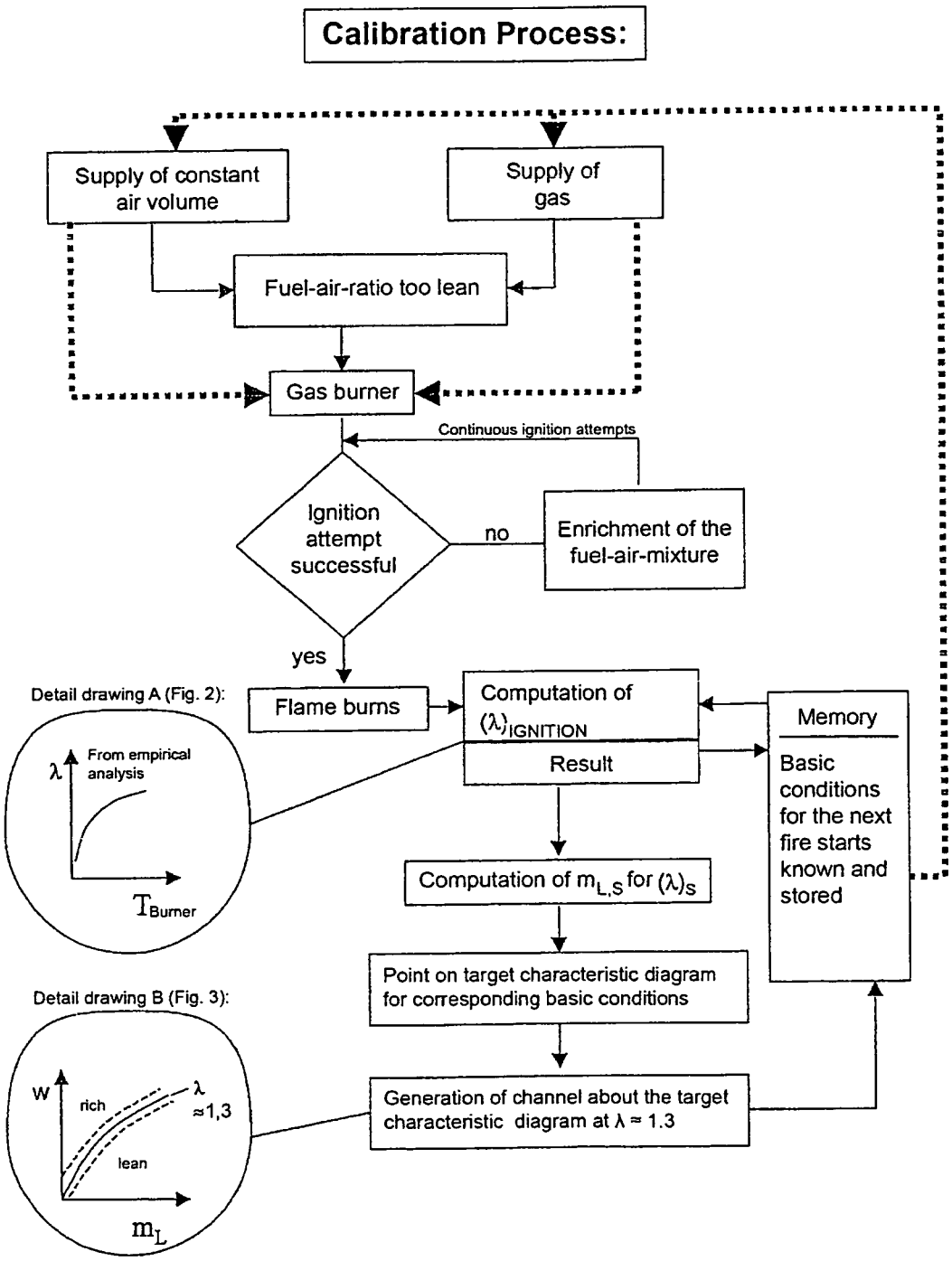

This application is a 371 U.S. National Stage of International Application No. PCT/EP2007/001050, filed Feb. 7, 2007. This application claims the benefit of German Patent Application No. DE 10 2006 006 964.1, filed Feb. 14, 2006, which application is herein expressly incorporated by reference.

The invention relates to a method for starting a combustion device, in particular a gas burner, under unknown basic conditions, and in particular when a first ignition failure has occurred, wherein a characteristic diagram of a start air ratio depending on the burner temperature known from empirical analysis, is stored for the combustion device in a memory.

Gas heaters are used for preparing hot water in a boiler, for providing thermal heat and similar. In different operating phases, the unit has to fulfill different requirements. In particular, the starting process of the unit requires a fast ignition of the burner flame, and a subsequent power delivery adapted to the heat requirements. Due to the typically irregular use of the gas burner over the course of the day or the night, the basic starting conditions for the gas burner are generally unknown. Important variables for the basic starting conditions are in particular the burner temperature, the gas type, the gas pressure, the ambient pressure of the air and the humidity of the air. The crucial variable for igniting the burner is the start air ratio, by which the ratio of the air volume actually provided to the burner is described relative to the air volume, which is theoretically required for an optimum stoichiometric combustion. For an optimum combustion, the burner is operated with excess air. This means the target value for the air ratio for the hygienically optimum combustion during operation is approximately 1.3. Burners ignite at different gas/air ratios, depending on the basic conditions.

The power delivery of a gas burner depends on the frequently changing heat requirement. The power delivery is substantially determined by the adjustment of the supply of air and fuel gas and by the set mixing ratio of air and gas. The mixing ratio can e.g. be defined as the ratio of the mass flows or of the volume flows of the air and of the gas.

DE 100 45 270 C2 discloses a combustion device and a method for controlling the combustion device under various fuel qualities. In particular, the fuel air ratio is changed accordingly, when the gas quality changes. Thus, the mixture composition is regulated for each suitable fuel type, until the desired flame core temperature is reached. Furthermore, characteristic diagrams are being used for various fuels, from which a new, suitable fuel/air ratio is read out each time when the power requirements change. A method for starting the burner is not disclosed.

In GB 2 270 748 A, a control system for a gas burner is shown. The control is performed here using a temperature measured at the burner surface. Since the surface temperature depends on the flow rate of the air-gas-mixture, the speed of the blower rotor is reduced when a certain temperature is undershot, which reduces the airflow and thus the air-gas-ratio. The starting process of the burner and the process steps in conjunction therewith are not individually described.

From AT 411 189 B, a method for controlling a gas burner is known, in which the CO concentration in the exhaust gases of the burner flame is detected by an exhaust gas sensor. A certain CO-value corresponds to a certain gas-air-ratio. Based on a known e.g. experimentally derived gas-air-ratio at a certain CO-value, a desired gas-air-ratio can be adjusted. For starting, the burner regulates the gas-air-mix according to a standard setting adjusted to a particular type of gas, but does not consider the case that basic conditions change, or that the starting process fails.

EP 770 824 B1 shows a control of the gas-air-ratio in the fuel-air-mix by measuring an ionization flow, which depends on the excess air in the exhaust gases of the burner flame. During stoichiometric combustion, it is known that a maximum of the ionization flow is measured. Depending on this value, the mixture composition can be optimized. The starting process is performed by an automated starting system, which generates a startup speed of the blower by means of a target value generator, wherein an ignitable mixture is present at said startup speed. The case where a startup attempt fails is also not considered.

The disadvantage of said methods is the prerequisite that in order to perform them, either the burners have to already have been started, or insufficient starting methods adjusted to fixed basic conditions are used. One disclosure integrates the startup process of a burner into the description, wherein said startup process is implemented by an automated starting system, which uses only the blower as a controlled variable. This is not sufficient for considering different unknown basic conditions and for reacting upon an ignition failure.

It is the object of the present invention to provide a method for starting a combustion device under unknown basic conditions.

The object is accomplished in a generic method by calibrating the startup process in several steps, wherein the ratio of opening the gas valve relative to air volume required for ignition is determined by iteration and variation of the gas and/or air volume, and in case of ignition, the combustion device is started and the applicable air ratio is stored.

According to the invention, the calibration according to claim 1 is performed in the following steps:

- Feeding a fuel-air-mix, which is too lean to the burner, so that no ignition can occur;
- continuous slow enriching of the fuel-air-mix by opening the gas valve under continuous ignition attempts;
- when ignition occurs: computation of the air ratio $(\lambda)_{IGNITION}$ from the burner temperature by means of a stored characteristic diagram;
- computation of the target mass flow of the combustion air $m_{L,S}$ for the target air ratio $(\lambda)_S$ from the size of the measured actual mass flow and from the computed air ratio $(\lambda)_{IGNITION}$ at the time of ignition;
- storing the target air ratio $(\lambda)_{IGNITION}$ for future starting processes;
- determining a channel from the characteristic diagram resulting from the calibrations.

During the first startup of a gas burner, the basic conditions are entirely unknown. The composition of the gas as well as the basic conditions are of crucial importance for the operation of the burner. In order to assure a safe startup process, it is advantageous according to the invention to perform a calibration, in which the significant influencing factors are determined and considered. It has to be possible, however, that the startup process can be safely repeated over and over again during normal operation after the first startup, depending on the heat requirement. For this purpose, a calibration is also advantageous, since this way, various demand situations can be reacted upon accordingly. Storing the air ratios, determined during the calibration for the different start processes, provides the opportunity to use said numbers for future startups. This is useful for a safe and fast startup of the gas burner.

An automated starting system as disclosed in the state of the art cannot comprise said advantages, since said starting system has to be adjusted to exactly determined basic conditions and cannot react upon unknown basic conditions.

The calibration is performed by a method comprising several steps. The supply of a fuel-air-mixture, which is too lean, to the burner and the continuous slow enriching of the gas-air-mixture by opening the gas valve has the great advantage that no deflagration of an accumulated not combusted gas-air-mixture can occur. As a matter of principle, also an approach of the mixture from a mixture, which has too high gas content, and which is too rich, to a mixture with a higher air content, which is leaner, is possible until an ignitable fuel-air-mixture exists at the burner, however, such an approach would be very disadvantageous from a safety point of view. The computations during the calibration process can be performed quickly and simply. Upon ignition, the air ratio and the target mass flow of the combustion air are computed by means of a characteristic diagram, which can be queried from a memory, so that the burner can be directly switched into operating mode. Storing the computed results has the advantage of an even faster starting process in the future.

It is furthermore advantageous when the particular results are not only stored, but used to develop a characteristic diagram about which a channel is defined. Said channel is an important tool for each subsequent starting process and for the operation, because it defines an area in which the burner can be safely started and operated in the different power spectra. This has the great advantage that possible malfunctions, which become apparent through an operation of the gas burner outside of the channel, can be safely determined, and the burner is turned off for safety reasons after a predetermined period of time.

It is also advantageous to perform the change of the opening of the gas valve by modulating a pulse width, by varying a voltage or a current of a solenoid valve or by actuating a stepper motor of a valve. This way, the gas valve can implement the required opening cycles quickly and safely.

It is furthermore advantageous that an empirically determined characteristic diagram of start air ratios at known basic conditions is stored in a memory for the combustion device for computing the actual start air ratio. At different burner temperatures, therefore, different start air ratios are determined in advance, which describe the stored characteristic diagram. By means of the characteristic diagram, the actual start air ratio can be simply computed during the calibration process by measuring the burner temperature.

Figure 2:
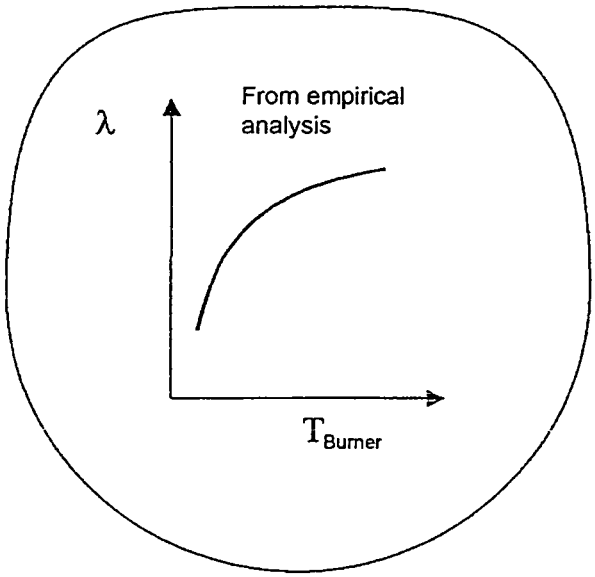
Figure 3:
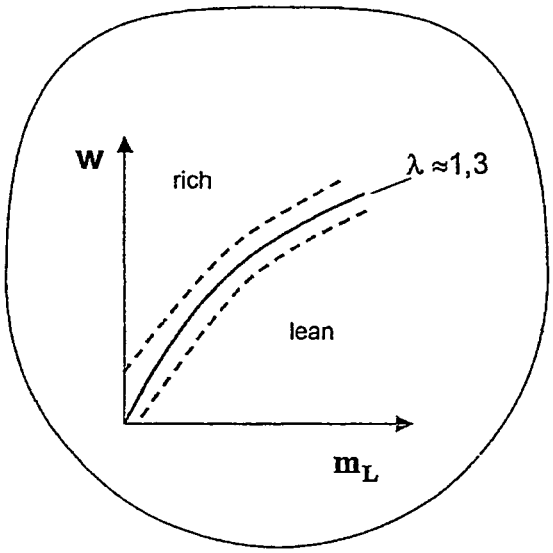

Additional features and advantages of the method according to the invention can be derived from the following description. It is shown in:

FIG. 1 a flow chart of the calibration process;

FIG. 2 a characteristic diagram, which is stored for the combustion device from empirical analysis;

FIG. 3 a characteristic diagram, comprising a channel, wherein said characteristic diagram is computed during the calibration process.

FIG. 1 shows a flow chart which illustrates the particular steps of the calibration process.

The flow chart can be read according to the illustrated arrows step by step from the top to the bottom. Steps depicted below one another are performed subsequently. Steps depicted next to one another are depicted simultaneously. Each step corresponds to a rectangular box.

At the beginning of a calibration process, gas is mixed with a constant air volume. The fuel-air-mixture initially generated therefrom is too lean intentionally; this means the gas content is too small to be ignited. This way, a starting situation is assured where no unexpected ignition, which could generate an explosion risk, can occur.

Through slow, continuous opening of the gas valve with a constant air-mass-flow, the fuel-air-mixture flowing to the burner is enriched; this means the ratio of supplied gas volume to the supplied air volume is increased. Simultaneously, continuous ignition attempts are made by the ignition system with the continuously increased gas content of the mixture.

When the unknown ratio between gas volume and air volume, which is necessary for ignition, is reached for the respective basic conditions, the mixture ignites and the gas burner is started. The burner temperature is measured precisely at the moment of ignition. The actual air ratio at the moment of ignition is computed by means of said actually measured temperature and the characteristic diagram of the relationship between start air ratio and burner temperature, wherein said characteristic diagram is stored in the memory.

The result of said computed air ratio at the time of ignition at the burner temperature measured accordingly is stored, so that the air ratio is available for future startup processes.

Furthermore, the target-mass-flow of the air volume to be supplied is computed from said air volume to be supplied. Subsequently, the supplied air volume can be changed from a measured actual value to a computed target value, wherein the opening of the gas valve is known and constant, so that the target air ratio is reached. The target air ratio is located on a characteristic target diagram, which describes the desired ratio of air volume to gas volume or $m_{L,\ actual}/m_{L,\ min}$ at different heat/power requirements. A channel is generated about said target characteristic diagram, which is at least large/wide enough, so that the computed start air ratio is disposed within said corridor. The target diagram and the generated channel are stored in the memory, so that future start processes are performed according to the different heat/power requirements according to said channel. The previously unknown basic conditions of the gas burner have been converted through the calibration process into known basic conditions for the subsequent starting processes.

A control of a target-air-ratio from the computed start air ratio can be performed by a change of the supplied air volume when the gas opening is held constant.

By forming a channel along the air-mass-flow, it is possible to ignite in a parameter range adapted to the heat/power requirement. If an ignition were performed at high power, though there is only a small heat requirement, a lot of energy would be inducted into the heating system, which in the extreme leads to switching off the gas burner again immediately. Therefore, at a low power requirement, a certain small gas opening and a corresponding air volume can be controlled. In case a large amount of power is needed quickly, e.g. when heating water for service use, the maximum heat/power delivery is directly available through a controlled large opening of the gas valve with a corresponding air volume, without having to slowly approach maximum power from a limited ignition power.

The channel generated simultaneously also puts up limits for normal operation, within which the gas burner is operated. When it is determined that said limits are exceeded or undershot for a certain period of time, this indicates a malfunction. This can e.g. be a deviation of the gas pressure from the allowable input pressure range, a deviation of the gas, or a malfunction of sensors. The gas burner turns off automatically in this case after a predetermined time period.

FIG. 2 shows a detailed sketch of the characteristic diagram stored for the combustion device in a memory. Said characteristic diagram is derived from a function of start air ratio and burner temperature–f $(T_{Burner})=\lambda$.

The burner temperature is a crucial parameter with respect to the start air ratio required for starting. A characteristic diagram can be derived from several previously performed start attempts, wherein said characteristic diagram determines the start air ratio depending on the burner temperature, and is stored in the combustion device in a memory. For determining said characteristic diagram, a fuel-air-mixture which is too lean is slowly enriched under continuous ignition attempts until ignition occurs. The air ratio at the moment of ignition is recorded. By repeating said process under various burner temperatures, the desired characteristic diagram results from the particular results. Through storing the characteristic diagram in a memory, it can be accessed any time.

FIG. 3 illustrates a detailed sketch of the characteristic diagram generated by the calibration process and the channel (in dashed lines) determined for said diagram.

The significant influencing variables for mixture generation are the supplied gas volume $m_G$ and the air volume $m_L$. The gas volume $m_G$ thus depends on the opening (w) of the gas valve. In order to assure a hygienic operation, the combustion device is operated at an air ratio of approximately $\lambda=1.3$. The characteristic diagram is disposed in the illustrated diagram, depending on the basic conditions, slightly offset in the direction of the upper or lower portion. In the upper portion, the fuel-air-mixture is richer; in the lower portion it is leaner. A channel is defined about the characteristic diagram, by which limits for operation and a safe range for the air ratio for subsequent starting processes is predetermined. The upper limit limits the combustibility of the fuel-air-mixture towards the rich area; the lower limit limits it towards the lean area.

The invention claimed is:

1. A method for starting a combustion device, in particular for starting a gas burner, under unknown basic conditions, the method comprising:

using a characteristic diagram of a start air ratio measured at a moment of ignition depending on a burner temperature measured at the moment of ignition known from empirical analysis wherein the characteristic diagram is stored for the combustion device in a memory, wherein, after an ignition failure of the combustion device, a) a calibration of the starting process is performed, wherein a ratio of an opening of a gas valve (w) to air volume $m_L$ necessary for ignition is iteratively determined by variation of the gas and/or air volume; and b) in case of ignition, the combustion device is started and the applicable air ratio $(\lambda)_{IGNITION}$ is determined using the characteristic diagram and stored in the memory, wherein the determined and stored values for the air ratio $(\lambda)_{IGNITION}$ are used for future starting processes.

2. The method in particular according to claim 1, wherein the calibration is performed by the following steps:

feeding a fuel-air-mix, which is too lean, to the burner, so that no ignition can occur;

continuous slow enriching of the fuel-air-mix by opening the gas valve (w) and/or reducing the fed air volume under continuous ignition attempts;

when ignition occurs: computation of the air ratio $(\lambda)_{IGNITION}$ from the burner temperature by means of a stored characteristic diagram;

computation of a target mass flow of the combustion air $m_{LS}$ for the target air ratio $(\lambda)_S$ from the size of the measured actual mass flow of the combustion air and from the computed air ratio $(\lambda)_{IGNITION}$ at the point in time of ignition; and storing the target air ratio $(\lambda)_{IGNITION}$ for future starting processes.

3. The method according to claim 1, wherein a characteristic diagram is generated by respective calibrations, along which a channel is defined, within which, or at whose boundaries the combustion device is operated.

4. The method according to claim 3, wherein the characteristic diagram is defined by the function $w=f(m_L)$, with w=opening of the gas valve and $m_L$=air volume.

5. The method according to claim 2, wherein after the computation of the target mass flow of the combustion air $m_{LS}$ for the target-air-ratio $(\lambda_S)$, an immediate controlling of the computed target operating condition by means of the computed target values follows.

6. The method according to claim 5, wherein the immediate controlling of the computed target operating condition with respect to the target values is performed by adapting the gas and/or air volume.

7. The method according to claim 5, wherein a control of the burner operation is performed after the immediate controlling of the computed target operating condition.

8. The method according to claim 3, wherein exceeding the upper boundary of the channel or undershooting the lower boundary of the channel is detected.

9. The method according to claim 7, wherein operating the combustion device outside of the boundaries of the channel causes the combustion device to be switched off after a predetermined time period has expired.

10. The method according to claim 1, wherein the adjustment of the gas valve opening is performed by varying a voltage or a current of a solenoid valve, the modulation of a pulse width, or by regulating a stepper motor of a valve.

11. The method for igniting a gas-air-mixture under known basic conditions after performing the method according to claim 1, wherein a characteristic diagram, which is empirically determined for the combustion device and stored in a memory, is used as start air ratio $(\lambda)_{START}$ for starting.

12. The combustion device, in particular a gas burner, wherein the gas burner is ignited and started according to claim 1.

13. A method for starting a gas burner, under unknown basic conditions, the method comprising:

obtaining a characteristic diagram of a start air ratio measured at a moment of ignition depending on a burner temperature measured at the moment of ignition from empirical analysis from a memory;

attempting ignition of the gas burner;

determining if a failure of the ignition of the gas burner occurs;

performing a calibration of the starting process when the failure of the ignition of the gas burner occurs, the performing step comprising:

a) iteratively determining a ratio of an opening of a gas valve to air volume necessary for ignition by variation of the gas and/or air volume;

b) determining the applicable air ratio using the characteristic diagram when ignition occurs and the gas burner is started;

c) storing the applicable air ratio in the memory;

using the determined and stored values for the air ratio for future starting processes.

14. The method of claim 13, wherein the iteratively determining step includes providing a lean fuel to air ratio to the gas burner and increasing the fuel to air ratio until the ignition occurs and the gas burner is started.

* * * * *